US006834684B2

(12) United States Patent
Martin et al.

(10) Patent No.: US 6,834,684 B2
(45) Date of Patent: Dec. 28, 2004

(54) PAIRED WARP TRIPLE LAYER FORMING FABRICS WITH OPTIMUM SHEET BUILDING CHARACTERISTICS

(75) Inventors: Chad A. Martin, Menasha, WI (US); Scott Quigley, Townville, SC (US)

(73) Assignee: Albany International Corp., Albany, NY (US)

( * ) Notice: Subject to any disclaimer, the term of this patent is extended or adjusted under 35 U.S.C. 154(b) by 52 days.

(21) Appl. No.: 10/279,634

(22) Filed: Oct. 24, 2002

(65) Prior Publication Data

US 2004/0079434 A1 Apr. 29, 2004

(51) Int. Cl.[7] ..... D03D 15/00

(52) U.S. Cl. ..... 139/383 A; 139/425 R; 139/410; 442/206; 162/348

(58) Field of Search ..... 139/383 A, 408–413, 139/425 R; 442/206, 221, 224; 162/348, DIG. 1

(56) References Cited

U.S. PATENT DOCUMENTS 4,224,372 A * 9/1980 Romanski ..... 442/187
4,357,386 A * 11/1982 Luciano et al. ..... 442/30
4,501,303 A 2/1985 Osterberg
4,569,883 A * 2/1986 Renjilian ..... 442/194
4,588,632 A * 5/1986 Gisbourne et al. ..... 428/212
4,605,585 A 8/1986 Johansson
4,632,716 A * 12/1986 Smith ..... 156/148
5,077,116 A * 12/1991 Lefkowitz ..... 428/141
5,152,326 A 10/1992 Vohringer
5,465,764 A * 11/1995 Eschmann et al. ..... 139/383 A
5,871,887 A * 2/1999 Trokhan et al. ..... 430/320
6,223,780 B1 5/2001 Kaldenhoff
6,294,485 B1 * 9/2001 Hodson et al. ..... 442/85
6,368,465 B1 * 4/2002 Stelljes et al. ..... 162/358.2

FOREIGN PATENT DOCUMENTS

WO WO 02/00996 A1 1/2002

* cited by examiner

*Primary Examiner*—Gary L. Welch
*Assistant Examiner*—Robert H. Muromoto, Jr.
(74) *Attorney, Agent, or Firm*—Frommer Lawrence & Haug LLP; Ronald R. Santucci

(57) ABSTRACT

A papermaker's fabric, usable in the forming section of a paper machine, having two layers of cross-machine-direction (CD) yarns. Interwoven with the CD yarns is a system of MD yarns. The MD yarns are grouped into alternating pairs comprising a crossing pair having a first MD yarn and a second MD yarn and a second pair having a third MD yarn and a fourth MD yarn. The first MD yarn and the second MD yarn combine to weave each CD yarn in the first layer and cross between the first layer and the second layer. The left and right warp yarns in the pairs are aligned in such a way that like adjacent yarns from adjacent pairs have MD cell lengths equal to or less than the MD cell lengths from non-like adjacent yarns from adjacent pairs. The third MD yarn is interwoven with the first layer of CD yarns and the fourth MD yarn is interwoven with the second layer of CD yarns. In this manner, a paired warped triple layer forming fabric may be produced which minimizes drainage and crossover point topographical markings.

22 Claims, 9 Drawing Sheets

PAIRED WARP TRIPLE LAYER FORMING FABRICS WITH OPTIMUM SHEET BUILDING CHARACTERISTICS

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament, plied monofilament, multifilament or plied multifilament yarns, and may be single-layered or multi-layered. The yarns are typically extruded from any one of several synthetic polymeric resins, such as polyamide and polyester resins, used for this purpose by those of ordinary skill in the paper machine clothing arts.

This invention describes a fabric that breaks up undesirable drainage marks in forming fabrics that use pairs of integral machine direction (MD) binding yarns to hold multi layer fabrics together. In the prior art, the MD yarns may be comprised of as little as 10% binders or as many as 100% binders. References describing fabrics with paired integral MD yarns are U.S. Pat. No. 4,501,303 (the "Österberg" patent) where these pairs are an integral part of the top weave but act as binding yarns on the bottom weave, U.S. Pat. No. 5,152,326 (the "Vohringer" patent) which focuses on these pairs making up at least 10% of the MD yarns and are integral parts of both the top and bottom weave and U.S. Pat. No. 4,605,585 (the "Johansson" patent) which has 100% of the MD yarns made up of these pairs. The disadvantages of Österberg, Vohringer and Johansson are either strong topside diagonals or strong drainage diagonals formed from how the yarns cross each other and align in the woven cloth. (The Vohringer patent will be described in detail later.)

FIG. 3 is a forming side view of a fabric woven in accordance with the teachings of the Johansson patent. The Johansson patent describes a double layer forming fabric with one warp system that is made of pairs of MD yarns that alternate making the top and bottom side of the cloth. While one of the pairs is weaving the topside weave pattern the other is weaving the bottom side weave pattern. The pairs then cross between the top and bottom side of the cloth so that the yarn weaving the topside of the weave pattern is now weaving the bottom side and vice versa. As described by Johansson, the pairs make up 100% of the MD yarns. In FIG. 3, the crossover points 300, where the two yarns in a pair cross each other, are circled. Notice how the crossover points line up to make a strong topographic diagonal pattern. The diagonal line 310 highlights a sequence of crossover points along the same diagonal pattern. Unfortunately, when using 100% paired integral MD yarns, it is impossible to spread the crossover points far enough apart to eliminate this strong topographical defect formed by the crossover points lining up in a diagonal pattern.

The design of forming fabrics additionally involves a compromise between the desired fiber support and fabric stability. A fine mesh fabric may provide the desired paper surface properties, but such design may lack the desired stability resulting in a short fabric life. By contrast, coarse mesh fabrics provide stability and long life at the expense of fiber support. To minimize the design tradeoff and optimize both support and stability, multilayer fabrics were developed. For example, in double and triple layer fabrics, the forming side is designed for support while the wear side is designed for stability.

In addition, triple layer designs allow the forming surface of the fabric to be woven independently of the wear surface. Because of this independence, triple layer designs can provide a high level of fiber support and an optimum internal void volume. Thus, triple layers may provide significant improvement in drainage over single and double layer designs.

Essentially, triple layer fabrics consist of two fabrics, the forming layer and the wear layer, held together by binding yarns. The binding is extremely important to the overall integrity of the fabric. One problem with triple layer fabrics has been relative slippage between the two layers which breaks down the fabric over time. In addition, the binding yarns can disrupt the structure of the forming layer resulting in marking of the paper.

The present invention is a paired warp triple-layer fabric where like adjacent yarns from adjacent pairs have MD cell lengths equal to or less than the MD cell lengths from non-like adjacent yarns from adjacent pairs. The present invention provides a solution to the problems of minimizing topographical and drainage markings resulting from warp crossover points and the arrangement of the left and right warps at the crossover points. This invention also minimizes the slippage between layers of the fabric.

SUMMARY OF THE INVENTION

Accordingly, the present invention is a forming fabric, although it may find application in the forming, pressing and drying sections of a paper machine.

The fabric is a triple layer forming fabric having an optimum arrangement of paired warp binding yarns that includes a first layer and a second layer of cross-machine direction (CD) yarns. The first layer of CD yarns forms a forming side of the fabric and the second layer of CD yarns forms a wear side of the fabric. Interwoven with the CD yarns is a system of machine direction (MD) yarns. The MD yarns are grouped into pairs comprising a crossing pair having a first MD yarn and a second MD yarn and a second pair having a third MD yarn and a fourth MD yarn. The crossing pair is interwoven with the first and second layers of CD yarns. This pair can be woven from one warp beam if the contours of the first MD yarn and the second MD yarn are symmetric. If non-symmetric warp contours in the pair are desired, two beams can be used to weave the crossing pair. The third MD yarn is interwoven with the first layer of CD yarns coming from its own warp beam and the fourth MD yarn is interwoven with the second layer of CD yarns coming from its own warp beam. At least 3 warp beams are needed to weave patterns with crossing pairs having symmetric warp contours and at least 4 warp beams are needed if the crossing pairs have non-symmetric warp contours.

The fabric is disposed on the forming section in endless form. The invention's fabric pattern minimizes drainage and topographical markings which result from the arrangement of the warp crossover points and the alignment of the yarns in each crossing pair. This is achieved by like adjacent yarns from adjacent pairs having MD cell lengths equal to or less than MD cell lengths from non-like adjacent yarns from adjacent pairs. In a particularly useful case, when the crossover point repeat pattern length in the CD can be divided into the CD weave pattern repeat and the outcome is a multiple of two, and like yarns in crossovers along the same CD line extend in opposite directions, the pattern can be woven on a loom with half the number of frames for a pattern repeat if the loom is threaded in a "fancy" draw. This is advantageous to the manufacturer since lower cost and less complex looms are needed.

Other aspects of the present invention include that the fabric may further comprise a third layer of CD yarns between the first and second layers. The shute ratio of the fabric may be varied; e.g. a 1:1 or a 2:1 shute ratio. Further, the CD yarns of the first layer and the second layer may not be in vertically stacked positions. In addition, each MD yarn in the crossing pair may pass over different numbers of consecutive CD yarns when crossing between the first layer and the second layer.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 3:
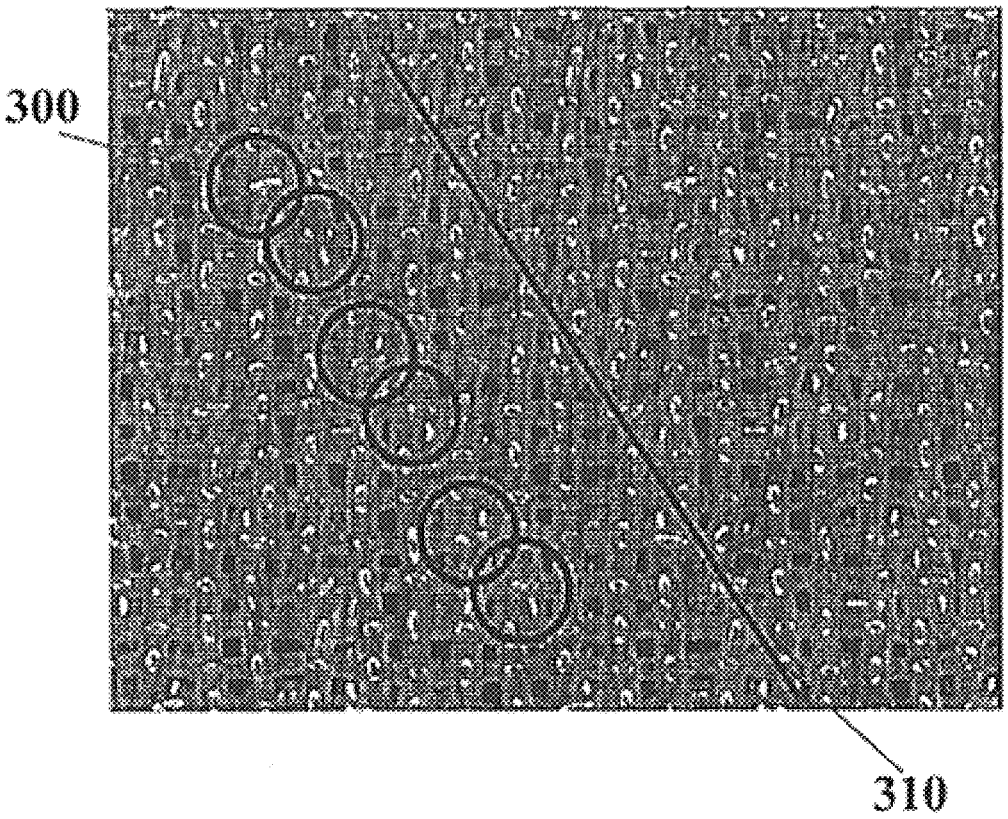
FIG. 3 is a forming side view of a fabric woven in accordance with the teachings of the Johansson patent.

To counter the strong diagonal crossover pattern 310 exhibited by the fabrics taught in the Johansson patent shown in FIG. 3, the present invention weaves a second MD yarn pair between the crossing pairs to spread the crossover points. At least one of the yarns in this second pair will be part of the forming side weave pattern. These additional yarns result in a second warp system and the resulting fabric structure becomes a triple layer. The crossing pairs now make up binding yarns that bind the top and bottom sides together and are an integral part of the topside weave. To add necessary MD tensile strength a third warp system is added below the second warp system. This third warp system makes up the wear-side of the cloth with the crossing pairs either binding the wear-side or acting as an integral part of this bottom side weave.

Figure 1:
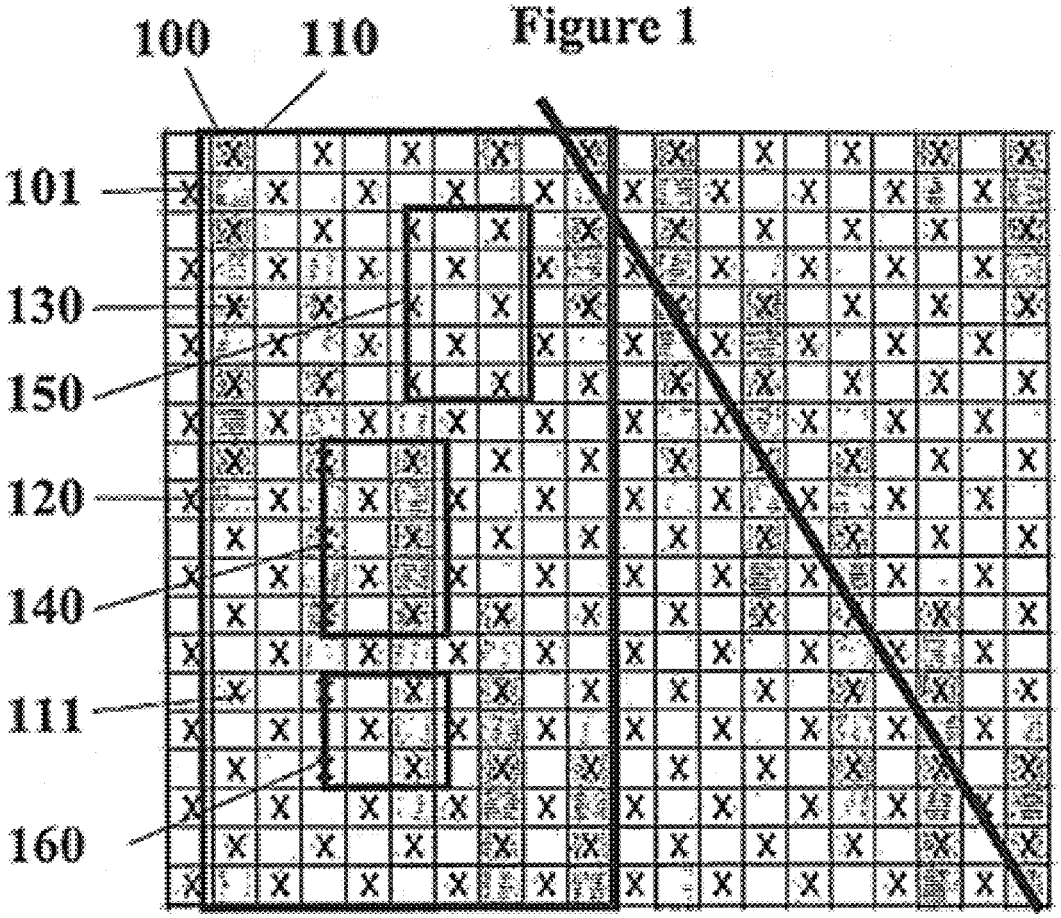
FIG. 1 shows a forming side plan view of a satin crossover arrangement with left and right warp yarns in the pairs aligned in such a way that like adjacent yarns from adjacent pairs have MD cell lengths greater than the MD cell lengths from non-like adjacent yarns from adjacent pairs.
Figure 2:
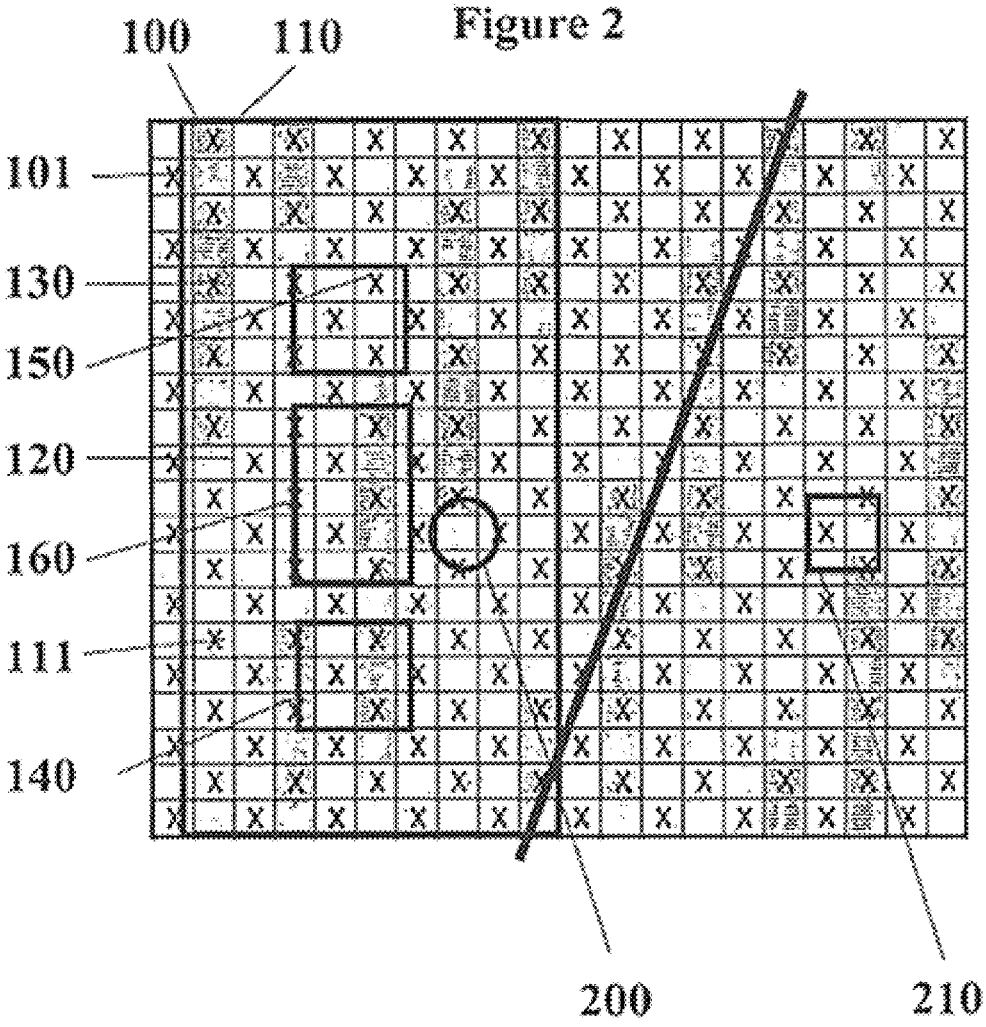
FIG. 2 shows a forming side plan view of a satin crossover arrangement with left and right warp yarns in the pairs aligned in such a way that like adjacent yarns from adjacent pairs have MD cell lengths less than the MD cell lengths from non-like adjacent yarns from adjacent pairs.

FIG. 1 shows an example of a forming side (FS) plan view of a paired warp fabric in a satin crossover arrangement with left and right warp yarns in the pairs aligned in such a way that like adjacent yarns from adjacent pairs have MD cell lengths greater than the MD cell lengths from non-like adjacent yarns from adjacent pairs which is undesirable. FIG. 2 shows a forming side (FS) plan view of a paired warp fabric according to the present invention in a satin crossover arrangement with left and right warp yarns in the pairs aligned in such a way that like adjacent yarns from adjacent pairs have MD cell lengths less than the MD cell lengths from non-like adjacent yarns from adjacent pairs which is optimum. Since the invention is directed to a triple layer fabric, the weave has separate forming side and wear side layers. The wear side patterns are not shown. Each layer is comprised of its own set of CD yarns. The pattern repeats in both the forming side and wear side layers after each set of CD yarns. Thus the views in FIGS. 1 and 2 show one complete pattern in the MD direction.

The invention uses four MD yarns which are grouped into alternating pairs. Each column in FIGS. 1 and 2 corresponds to a pair of MD warps. Each yarn in the first pair of MD warps weaves only the forming side or the wear side layer. Thus, the first column 100 (in FIGS. 1 and 2) shows the forming warp of the first pair where the warp knuckle is indicated by an "X" 101. The second pair of warps is a crossing pair which weaves between the forming side layer and the wear side layer. Thus, the second column 110 in FIGS. 1 and 2, contains the warps in the crossing pair. In these figures, warp knuckles formed by the left yarn of the crossing pair are indicated by an "X" 111 but fall on the same column as a crossover 120 which is indicated a single shaded box, warp knuckles formed by the right yarn in the crossing pair are indicated by an "X" but the sequence of knuckles 130 is highlighted by a shaded box which extends vertically up and down the column. For example, in the second column of FIG. 1, the right warp weaves five knuckles on the forming side and then crosses to the wear side while the left warp weaves with the wear side before crossing to the forming side for five knuckles. At which point, both the left and right warps cross again. Thus, as shown by every other column in FIGS. 1 and 2, each yarn in the crossing pair spans a number of CD yarns in a layer before crossing to the other layer. The box 140 highlights a cell in the pattern where the right yarns are adjacent to each other in adjacent pairs. The box 150 highlights a cell in the pattern where the left yarns are adjacent to each other in adjacent pairs. The box 160 highlights a cell in the pattern where the left yarn from one pair and the right yarn of the adjacent pair are adjacent to each other. When the MD length of the cells caused by like adjacent yarns from adjacent pairs (140 and 150) are longer than the cell caused by non-like adjacent yarns from adjacent pairs (160), the pattern will have a wide diagonal band corresponding to a strong diagonal mark in the paper sheet. The superimposed diagonal line in FIGS. 1 and 2 indicates the diagonal patterns formed by the arrangements of the left and right yarns of each crossing pair in the pattern. Note that the diagonal line in FIG. 2 is oriented closer to vertical than the diagonal line in FIG. 1, thus greatly reducing the drainage pattern cause by the alignment of the left and right yarns in the pair. This is because in FIG. 2, the MD length of the cells caused by like adjacent yarns from adjacent pairs (140 and 150) are now equal to or shorter than the cell caused by non-like adjacent yarns from adjacent pairs (160). FIG. 2 provides the best combination of crossovers and lefts and rights and is therefore a preferred embodiment of the present invention.

FIG. 2 also shows a crossover arrangement where like yarns in crossovers along the same CD line extend in opposite directions. The circle 200 and the square 210 highlight the same crossover point in the crossover repeat. However, the right and left yarns extend in an opposite manner at these crossovers. The right yarn at the crossover highlighted by the circle 200 extends upwards whereas the right yarn at the crossover highlighted by the square 210 extends downwards.

Figure 5:
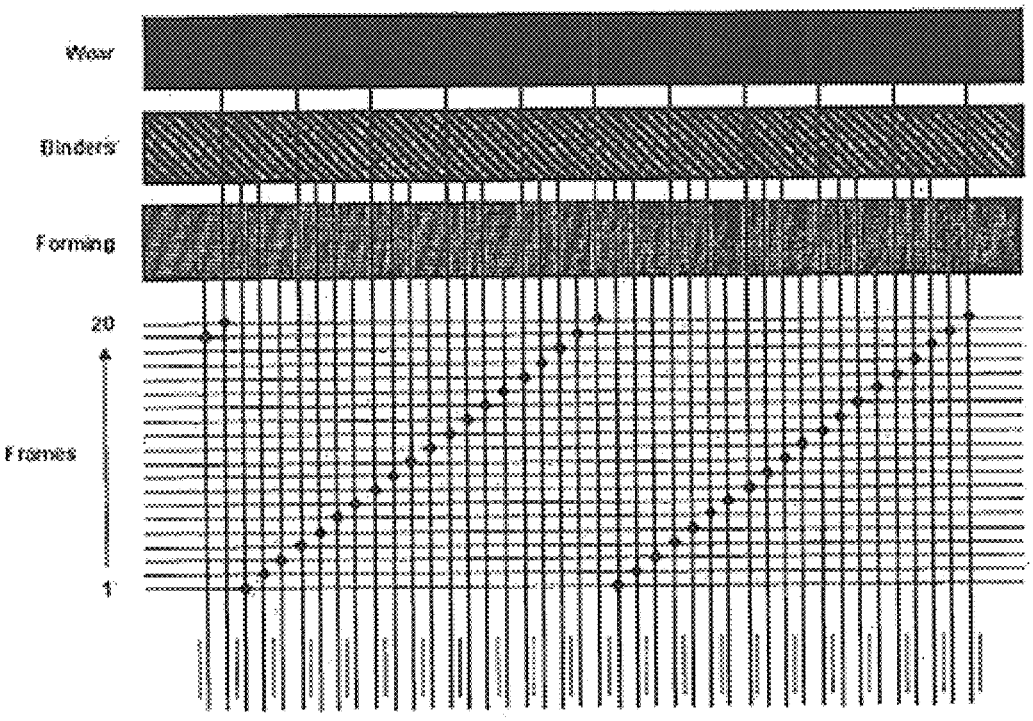
FIG. 5 is a schematic view showing one particular example of a harness loom setup with a straight draw.
Figure 6:
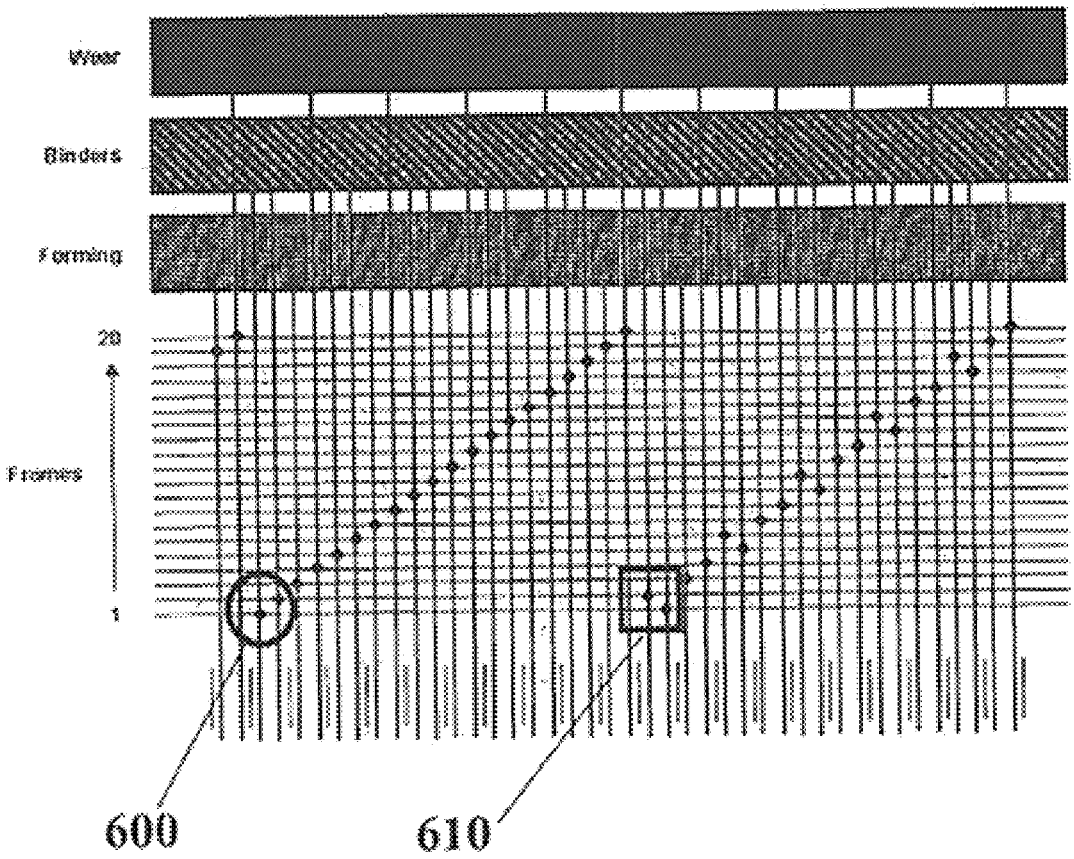
FIG. 6 is a schematic view showing one particular example of a harness loom setup with a fancy draw.

The pattern in FIG. 2 is a 40 MD yarn repeat (20 yarns on the top at all times) and can be woven on a 40 frame loom with a straight draw or a 20 frame loom with a "fancy" draw. FIG. 1 shows a crossover arrangement where like yarns in crossovers along the same CD line extend in the same direction, thus the crossover pattern and the weave pattern have the same repeat length and can not be woven with half the number of frames on a loom with a fancy draw. FIG. 6 shows a schematic view of one particular harness loom setup in a "fancy" draw having three warp beams to weave a triple layer fabric in accordance with the present invention. For comparison, FIG. 5 is a schematic view showing a similar harness loom setup in a straight draw. In FIGS. 5 and 6, the machine direction (MD) is vertical and the cross-machine direction (CD) is horizontal. Each column is an MD yarn and each row indicates a frame on the loom. Note the indicated fancy draw harnesses 610 and the straight draw harnesses 600 along the same frames in FIG. 6. The fancy draw reduces the required number of loom harnesses by half when weaving fabrics where like yarns in crossovers along the same CD line extend in opposite directions and the repeat length of the crossover pattern can be divided into the repeat pattern of the weave pattern and the result is a multiple of two. The present invention is applicable to 16 and 20 harness looms and looms having other numbers of harnesses. In fact, a 40 warp repeat is optimum for dispersing the crossovers and the arrangement of the left and right warp in each crossing pair. The weave pattern of each beam will be discussed later. Although the invention is preferably practiced in a 3-beam embodiment as shown, it may also be practiced with more than three beams if the paired warp yarns have non-symmetric contours. The crossing pairs may also be separated by more than one top and bottom MD yarn. The spacing between the yarns of the papermaker's fabric in this and other figures is exaggerated for the sake of clarity. A fancy draw is beneficial to the manufacturer where applicable since half the number of frames are required.

Figure 4:
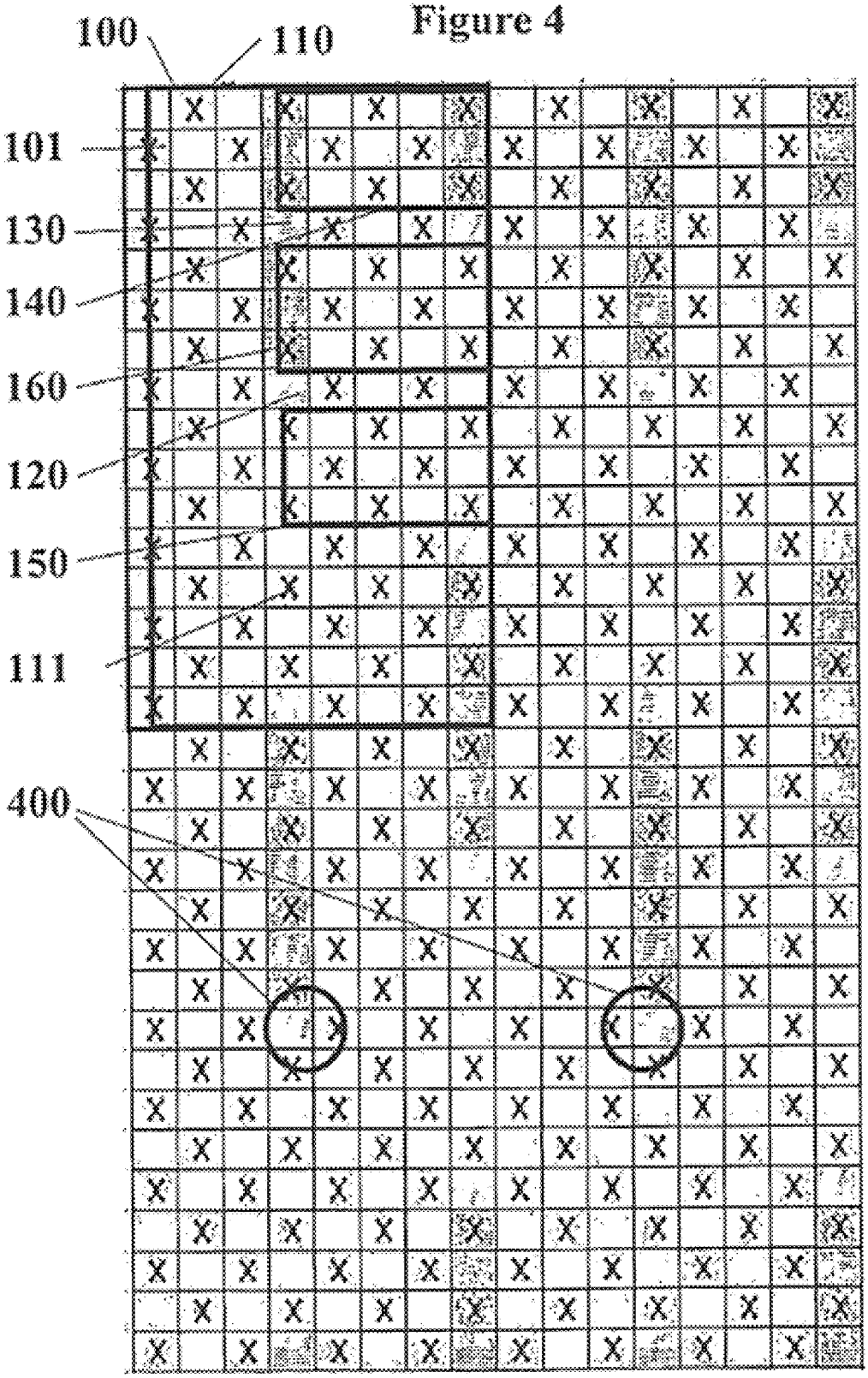
FIG. 4 shows a forming side plan view crossover arrangement in accordance with the teachings of Vohringer.

FIG. 4 shows a forming side (FS) plan view of a paired warp fabric in accordance with the Vohringer patent. The pairs of crossing warps here are separated by three top MD yarns. Notice the CD patterns formed by the alignment of the left and right yarns in the pair. This is undesirable due to the CD drainage marking it will introduce to the paper sheet. This crossover arrangement is aligned in such a way that like adjacent yarns from adjacent pairs have MD cell lengths equal to the MD cell lengths from non-like adjacent yarns from adjacent pairs. In this case, like yarns in crossovers along the same CD line must extend in opposite directions to minimize undesirable drainage marks. This fabric has like yarns in crossovers along the same CD line extending in the same direction, as indicated by the circles highlighting the same crossovers 400 along a CD line.

Figure 7A:
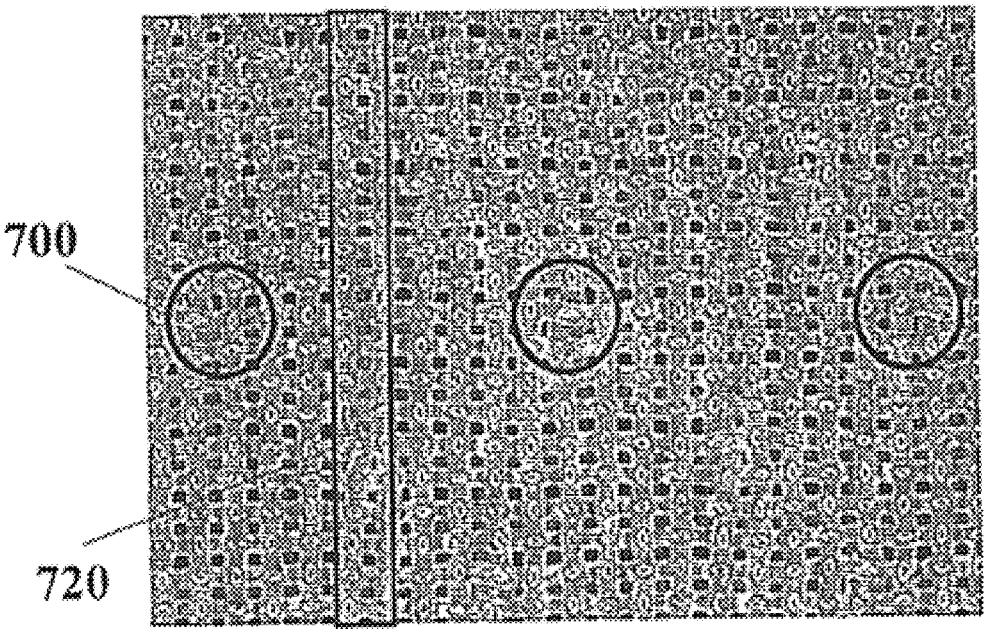
FIGS. 7A and 7B respectively show forming side views of fabrics woven with a satin crossover arrangement with left and right warp yarns in the pairs aligned in such a way that like adjacent yarns from adjacent pairs have MD cell lengths greater than the MD cell lengths from non-like adjacent yarns and a satin crossover arrangement with left and right warp yarns in the pairs aligned in such a way that like adjacent yarns from adjacent pairs have MD cell lengths less than the MD cell lengths from non-like adjacent yarns from adjacent pairs.
Figure 7B:
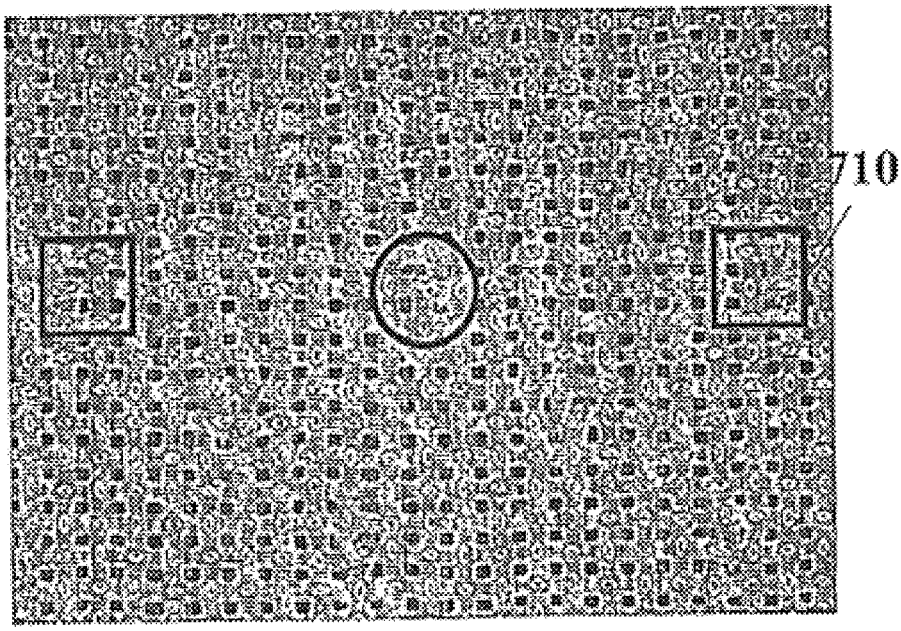

FIGS. 7A and 7B show forming side views of fabrics woven with a) a satin crossover arrangement with left and right warp yarns in the pair aligned in such a way that like adjacent yarns from adjacent pairs have MD cell lengths greater than the MD cell lengths from non-like adjacent yarns from adjacent and b) a satin crossover arrangement with left and right warp yarns in the pair aligned in such a way that like adjacent yarns from adjacent pairs have MD cell lengths less than the MD cell lengths from non-like adjacent yarns from adjacent pairs. The photo in FIG. 7A shows the forming side of a fabric woven in a 20 MD yarn repeat with the topside being plain weave and the bottom side being a 5-shed with two topside CD yarns for every one bottom side yarn. This fabric has 50% of the total warp system consisting of paired MD binders. The circles 700 highlight the crossover points along one CD line. The box 720 highlights a single pair of MD yarns. Notice that 50% of the warps are these pairs. The pairs are separated by one top MD yarn and one bottom MD yarn that is stacked below the top MD yarn.

Figure 8A:
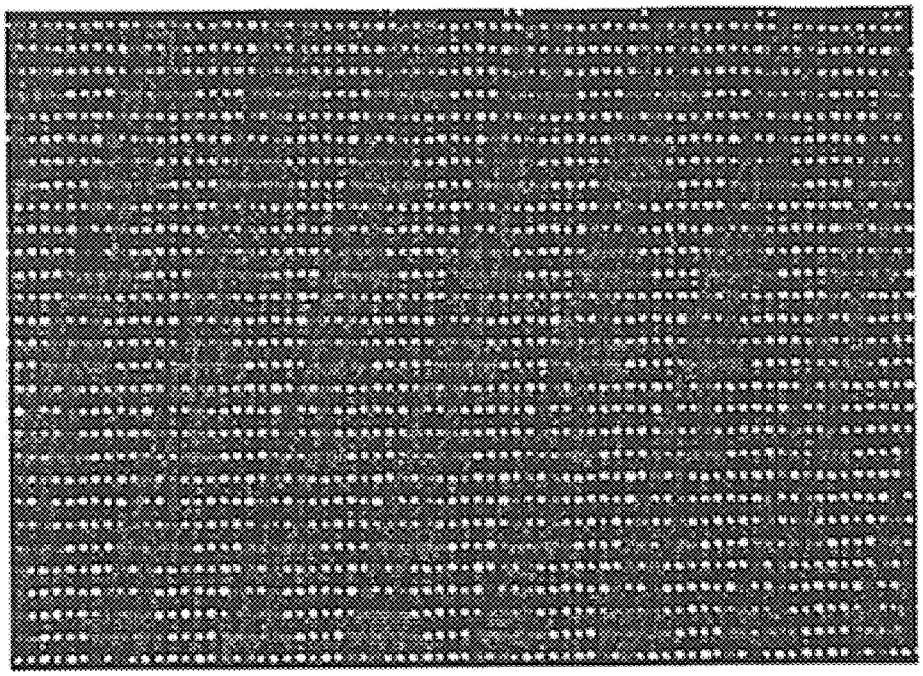
FIGS. 8A and 8B show light transmitted through the fabrics shown in FIGS. 7A and 7B, respectively.

Although in the pattern of FIG. 7A, the crossover points are evenly distributed throughout the forming side, thereby eliminating the strong topographical diagonal marks. A strong drainage diagonal is now evident internal to the fabric. This drainage diagonal problem is evident in FIG. 8A, which shows a photo of light transmitted through the fabric of FIG. 7A. Notice the strong diagonal dark and light areas. The darker areas represent closed areas of the cloth while the light areas represent more open areas. Drainage is impeded in the dark areas, thus leaving an undesirable drainage mark in the paper.

This drainage problem is due to the alignment of the left and right warp yarns in the pair. The left and right warp yarns in the pairs are aligned in such a way that like adjacent yarns from adjacent pairs have MD cell lengths greater than the MD cell lengths from non-like adjacent yarns from adjacent pairs. This sequence ultimately leads to the drainage marks indicated by FIG. 8A. This fabric also has like yarns in crossovers along the same CD line extending in same direction. As seen in FIG. 7A, each circle 700 highlights a crossover point of the left and right yarn of the pairs along one CD line. At the crossover points, all the right yarns extend upwards and all the left yarns extend downwards.

Figure 8B:
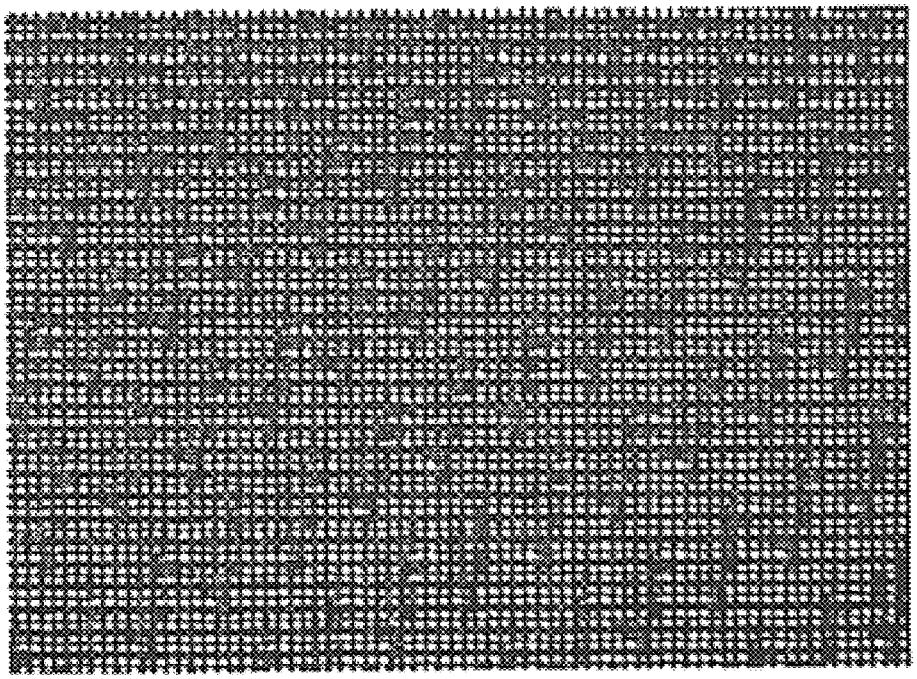

To eliminate the drainage mark problem, it is necessary to align the position of the yarns in the crossing pairs. A fabric according to the present invention is shown in FIG. 7B. This fabric is similar to the fabric in FIG. 7A, except the left and right warp yarns in the pairs are aligned in such a way that like adjacent yarns from adjacent pairs have MD cell lengths less than the MD cell lengths from non-like adjacent yarns from adjacent pairs. This fabric has like yarns in crossovers along the same CD line extending in opposite directions. The pairs go from the left yarn in the pair extending upward from the crossover 700 to the left yarn in the pair extending downward at crossover 710. As seen in the transmitted light photo of FIG. 8B, the strong dark diagonal is eliminated and the light and dark spots are more evenly distributed. Not only are the crossover points distributed for optimum topographical properties, but the positions of the left and right yarns in the pairs also produce optimum drainage properties.

Figure 9A:
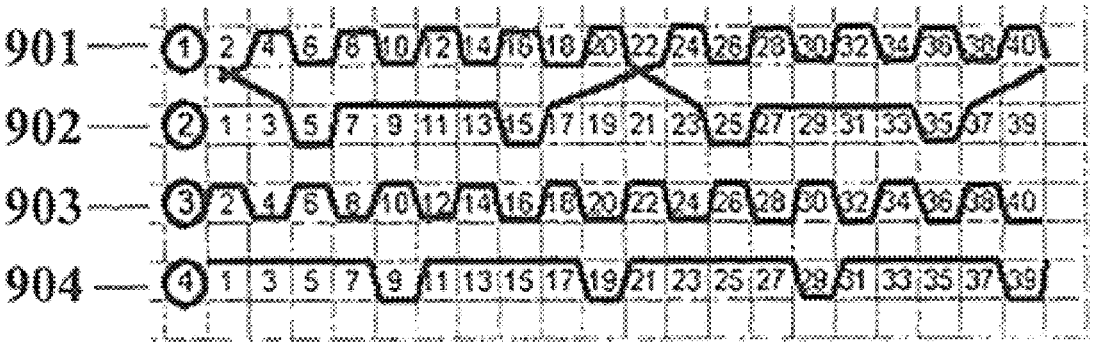
FIGS. 9A and 9B respectively show cross-sectional views of a particular example of a 1:1 and a 2:1 shute ratio paired warp triple layer according to the present invention.
Figure 9B:
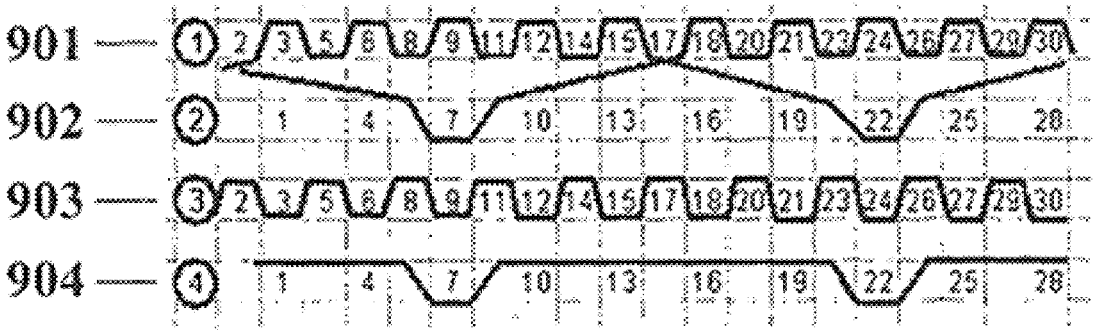

FIGS. 9A and 9B show cross-sectional views of particular examples of paired warp triple layer according to the present invention. FIG. 9A shows a 1:1 shute ratio pattern with the paired warp yarns acting as an integral part of the bottom side wear. FIG. 9B shows a 2:1 shute ratio pattern with the paired warp yarns acting as binders to the bottom side. In FIG. 9A, the even numbered CD yarns form the forming side layer while the odd numbered CD yarns form the wear side layer.

The crossing warp pair comprises a first warp 901 and a second warp 902. The second warp pair comprises a forming side warp 903 and a wear side warp 904. Warp 903 illustrates the second warp system that contributes to the forming side weave pattern and is woven between the paired integral binders to separate the crossovers. Warp 904 illustrates the third warp system that is stacked directly under the second warp system and contributes to the wear side weave pattern. The crossing paired warp yarns can act as binders or be an integral part of the wear side of the fabric. Thus, the first embodiment of the present invention has a first pair of crossing warps coming from a first warp beam, while each warp in the second pair of warps comes from a separate warp beam. This embodiment contains pairs that make up 50% of the total MD warp system. The second and third warp systems each contribute to 25% of the total warp system.

Other aspects of the present invention include that the pattern may have forming to wear-side shute ratios of 1:1, 2:1, 3:2, or any other shute ratio known in the art. The forming side shutes may be stacked or not stacked over the wear side shutes. The fabric may even include 3 stacked shutes thus comprising a third layer of CD yarns between the first and second layers. In addition, each MD yarn in the crossing pair may pass over different numbers of consecutive CD yarns when crossing between the first layer and the second layer. The crossing warps can weave integrally with the wear side pattern or they can act as binders. The crossing warps can intersect in a satin motif or have a straight twill motif. In the triple stacked shute fabrics, the crossing warps may weave from the surfaces to the center layer or from surface to surface, while the wear side warps may weave from the wear side to the center layer or only in the wear side. Note, these examples are simply representative examples of the invention and are not meant to limit the invention.

The fabric according to the present invention preferably comprises only monofilament yarns. Specifically, the CD yarns may be anticontaminant polyester monofilament. Such anticontaminant may be more deformable than standard polyester and, as a result, may more easily enable the fabric to be woven so as to have a relatively low permeability (such as 100 CFM) as compared to the more non-deformable yarns. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

CD yarns may be monofilament yarns of circular cross section of any of the synthetic polymeric resins used in the production of such yarns for paper machine clothing. Polyester and polyamide are but two examples of such materials. Other examples of such materials are polyphenylene sulfide (PPS), which is commercially available under the name RYTON®, and a modified heat-, hydrolysis- and contaminant-resistant polyester of the variety disclosed in commonly assigned U.S. Pat. No. 5,169,499, and used in fabrics sold by Albany International Corp. under the trademark THERMONETICS®. The teachings of U.S. Pat. No. 5,169,499 are incorporated herein by reference. Further, such materials as poly (cyclohexanedimethylene terephthalate-isophthalate) (PCTA), polyetheretherketone (PEEK) and others could also be used.

Modifications to the above would be obvious to those of ordinary skill in the art, but would not bring the invention so modified beyond the scope of the present invention. The claims to follow should be construed to cover such situations.

What is claimed is:

1. A papermaker's fabric comprising:

a first layer and a second layer of cross-machine direction (CD) yarns;

a system of machine-direction (MD) yarns, wherein the MD yarns are grouped into pairs comprising a crossing pair having a first MD yarn and a second MD yarn and a second pair having a third MD yarn and a fourth MD yarn;

wherein said crossing pair is interwoven with the first and second layers of CD yarns in such a manner that the first MD yarn and the second MD yarn combine to weave each CD yarn in the first layer and cross between the first layer and the second layer;

wherein the yarns in the pairs are aligned in such a way that like adjacent yarns from adjacent pairs have MD cell lengths greater to or less than the MD cell lengths from non-like adjacent yarns from adjacent pairs; and wherein said third MD yarn is interwoven with the first layer of CD yarns and said fourth MD yarn is interwoven with the second layer of CD yarns.

2. The papermaker's fabric according to claim 1, wherein the fabric is a triple layer forming fabric.

3. The papermaker's fabric according to claim 1, wherein the first layer of CD yarns forms a forming side of the fabric and the second layer of CD yarns forms a wear side of the fabric.

4. The papermaker's fabric according to claim 1, wherein the crossing pair is arrayed in a satin motif.

5. The papermaker's fabric according to claim 1, wherein the crossing pair is arrayed in a twill motif.

6. The papermaker's fabric according to claim 1, further comprising a third layer of CD yarns between the first and second layers.

7. The papermaker's fabric according to claim 1, wherein the fabric has a 1:1 shute ratio.

8. The papermaker's fabric according to claim 1, wherein the fabric has a 2:1 shute ratio.

9. The papermaker's fabric according to claim 1, wherein the fabric is produced in a 20 harness arrangement.

10. The papermaker's fabric according to claim 1, wherein the fabric is produced in a 40 harness arrangement.

11. The papermaker's fabric according to claim 1, wherein at least some of the MD yarns are one of polyamide yarns, polyester yarns, polyphenylene sulfide yarns, modified heat-, hydrolysis- and contaminant-resistant polyester yarns, poly(cyclohexanedimethylene terephthalateisophthalate) yarns, and polyetheretherketone yarns.

12. The papermaker's fabric according to claim 1, wherein at least some of the CD yarns are one of polyamide yarns, polyester yarns, polyphenylene sulfide yarns, modified heat-, hydrolysis- and contaminant-resistant polyester yarns, poly(cyclohexanedimethylene terephthalateisophthalate) yarns, and polyetheretherketone yarns.

13. The papermaker's fabric according to claim 1, wherein the fabric may be flat woven or in endless form.

14. The papermaker's fabric according to claim 1, wherein the CD yarns of the first layer and the second layer are in vertically stacked positions relative thereto.

15. The papermaker's fabric according to claim 1, wherein each MD yarn in the crossing pair passes over at least one CD yarn when crossing between the first layer and the second layer.

16. The papermaker's fabric according to claim 1, wherein three warp beams are used.

17. The papermaker's fabric according to claim 1, wherein more than three warp beams are used.

18. The papermaker's fabric according to claim 1, wherein the fabric is woven on a loom threaded in a fancy draw if like yarns in crossovers along the same CD line extend in opposite directions and the crossover pattern is a multiple of two of the weave pattern repeat.

19. The papermaker's fabric according to claim 1, wherein the paired warp binders are an integral part of the bottom side weave.

20. The papermaker's fabric according to claim 1, wherein the paired warp binders act as binders in the bottom side weave.

21. The papermaker's fabric according to claim 1, wherein the paired warp binders are separated by at least one topside MD yarn.

22. The papermaker's fabric according to claim 1, wherein at least some of the MD or CD yarns have round, rectangular, or a nonround cross-section.

* * * * *

UNITED STATES PATENT AND TRADEMARK OFFICE

CERTIFICATE OF CORRECTION

PATENT NO. : 6,834,684 B2
DATED : December 28, 2004
INVENTOR(S) : Chad A. Martin and Scott Quigley It is certified that error appears in the above-identified patent and that said Letters Patent is hereby corrected as shown below:

Column 9,
Line 28, "greater to" should be changed to -- greater than --.

Signed and Sealed this

Fifth Day of April, 2005

JON W. DUDAS
*Director of the United States Patent and Trademark Office*